US009386639B2

(12) United States Patent
Li et al.

(10) Patent No.: US 9,386,639 B2
(45) Date of Patent: Jul. 5, 2016

(54) WHITE LED LIGHT EMITTING DEVICE DRIVEN DIRECTLY BY CONSTANT ALTERNATING CURRENT

(71) Applicant: SICHUAN SUNFOR LIGHT CO., LTD., Chengdu, Sichuan (CN)

(72) Inventors: Dongming Li, Sichuan (CN); Mian Yang, Sichuan (CN); Zhengyong Feng, Sichuan (CN); Wentao Long, Sichuan (CN); Kun Zhao, Sichuan (CN); Ming Zhang, Sichuan (CN)

(73) Assignee: SICHUAN SUNFOR LIGHT CO., LTD., Sichuan (CN)

( * ) Notice: Subject to any disclaimer, the term of this patent is extended or adjusted under 35 U.S.C. 154(b) by 83 days.

(21) Appl. No.: 14/371,278

(22) PCT Filed: Dec. 25, 2012

(86) PCT No.: PCT/CN2012/087390

§ 371 (c)(1),
(2) Date: Aug. 13, 2014

(87) PCT Pub. No.: WO2013/104250

PCT Pub. Date: Jul. 18, 2013

(65) Prior Publication Data

US 2014/0346954 A1 Nov. 27, 2014

(30) Foreign Application Priority Data

Jan. 10, 2012 (CN) ..... 2012 1 0005714

(51) Int. Cl.
*H05B 37/00* (2006.01)
*H05B 41/00* (2006.01)
*H05B 33/08* (2006.01)

(52) U.S. Cl.
CPC ..... *H05B 33/0809* (2013.01); *H05B 33/0821* (2013.01); *H05B 33/0827* (2013.01); *H05B 33/0887* (2013.01)

(58) Field of Classification Search
None
See application file for complete search history.

(56) References Cited

U.S. PATENT DOCUMENTS 5,598,068 A * 1/1997 Shirai ..... 315/185 R

FOREIGN PATENT DOCUMENTS

| | | | |
|---|---|---|---|
| CN | 101106852 A | | 1/2008 |
| CN | 102202441 A | | 9/2011 |
| JP | 2006147933 A | * | 6/2006 |
| WO | 2007055519 A1 | | 5/2007 |

OTHER PUBLICATIONS

International Search Report mailed Mar. 28, 2013, in International Patent Application No. PCT/CN2012/087390.

* cited by examiner

*Primary Examiner* — Anh Tran
(74) *Attorney, Agent, or Firm* — Michael Ye; Andrews Kurth LLP

(57) ABSTRACT

The present invention discloses a white LED light emitting device driven directly by constant current in manner of being supplied with alternating current. N parallel branches, consisting of LED modules and constant current units which are in series connection with the LED modules, are connected to an output terminal of a rectification circuit, and by setting the current value, the turning-off voltage, and the turning-on voltage of the constant current unit of each branch, the periodic flickers generated due to changes in the voltage of the alternating current can be avoided. Because the current of each branch is constant, the changes in junction temperatures do not result in the current changing in LED, and the reliability is improved. Along with the increase of the number of the branches, the driving current waveform approximates a sine wave, and the power factor and the efficiency of the light emitting device are improved.

10 Claims, 4 Drawing Sheets

WHITE LED LIGHT EMITTING DEVICE DRIVEN DIRECTLY BY CONSTANT ALTERNATING CURRENT

This application claims priority to International Patent Application No. PCT/CN2012/087390, filed on Dec. 25, 2012. The entirety of the aforementioned is incorporated herein by reference.

FIELD

The present invention relates to a LED light emitting device, and particularly to a technology in which LED light emitting devices are directly driven by constant current in manner of being supplied with alternating current.

BACKGROUND

As a new type of solid state light source, the LEDs are hopeful to become a new generation of illumination source due to the advantages such as energy saving, environmental protection and long lifetime. It is well known that almost all of the existing LEDs are driven by the direct current, while the electricity for production and household is alternating current. Thus, the LED product used at present needs a power converter to convert alternating current into direct current. The introduction of the power converter brings many negative effects. Firstly, the service life of the power converter is far less than that of the LED, thus the service life of the illumination device is shortened. Secondly, the power converter decreases the efficiency of the light emitting device. Thirdly, in the small power applications, the power converter decreases the power factor and increases the total harmonic distortion of the current. In order to sufficiently exert the advantages of the semiconductor illumination, the LED light emitting device that can be directly driven by the alternating current becomes a research hotspot at present Most of the existing disclosed technologies of alternating current LED connect a plurality of LED modules in inverse-parallel, or in the circuit topological structure of a bridge rectifier, so as to meet the driving requirement of the alternating current. But the alternating current fluctuates periodically in a certain frequency, and the LED itself has a turning-on voltage, so the LED is turned on to emit light only when the instantaneous voltage exceeds the turning-on voltage, otherwise the LED is turned off and no light is emitted. Such a circuit leads to a very low luminescence efficiency of the LED, and flickers occur along with the fluctuation of the voltage of the alternating current.

The international patent WO2004/023568A1, entitled as "LIGHT-EMITTING DEVICE HAVING LIGHT-EMITTING ELEMENTS", proposes to integrate LED chip arrays on a sapphire substrate, so as to provide a light emitting device driven by the alternating current, but the problem of the LED flicker is not solved U.S. Pat. No. 7,489,086 B2, entitled as "AC LIGHT EMITTING DIODE AND AC LED DRIVE METHODS AND APPARATUS", provides an alternating current LED device, which encapsulates a plurality of LEDs integrally, so as to compensate for the LED flickers caused by the alternating current with the vision persistence effect of the human eyes. But the patent does not eliminate the flickers caused by the periodic fluctuation of the voltage of the alternating current.

It is clear that all the disclosed LED alternating current driving technologies have a defect that the LED driving current fluctuates with the voltage of the alternating current, thus the brightness varies when the LED emits light, and the flickers occur. Meanwhile, the core of the LED device is a PN junction diode, whose I-V characteristic is an approximate exponential function, and when the voltages at both ends of the LED exceed the turning-on voltage, the current flowing through the PN junction increases exponentially. The alternating current driving method of the prior art does not use the constant current circuit, and when the temperature of the LED junction rises, the turning-on voltage decreases. But the input voltage is not changed, thus the forward current of the LED increases rapidly, and even the PN junction of the LED may be thermally broken down and then permanently damaged in serious conditions.

SUMMARY

The technical problem to be solved by the present invention is to provide, aiming at the problem in the prior art of directly driving the LED light emitting device by alternating current, a white LED light emitting device driven directly by constant current in manner of being supplied with alternating current In order to solve the technical problem, the present invention adopts the following technical solution: a white LED light emitting device driven directly by constant current in manner of being supplied with alternating current, comprising an alternating current input terminal, a protection unit and a rectifier unit, characterized in that, a first branch, a second branch, . . . , and an $n^{th}$ branch are connected in parallel between a first output terminal and a second output terminal of the rectifier unit, the first branch consists of a first LED module and a first constant current unit connected in series, the second branch consists of a second LED module and a second constant current unit connected in series, . . . , and the $n^{th}$ branch consists of an $n^{th}$ LED module and an $n^{th}$ constant current unit connected in series, each constant current unit being connected to a sample unit, wherein $n \geq 1$ and is an integer;

the alternating current input terminal is connected to the alternating current, for supplying driving current to the device;

the protection unit is connected to the alternating current input terminal, for providing a protection function to the device;

the rectifier unit is connected to the protection unit, for rectifying the alternating current output from the protection unit;

the sample unit samples an output voltage of the rectifier unit, and outputs a control signal to each constant current unit;

each constant current unit is connected to the sample unit, for keeping the current of corresponding branch to be constant, and for turning-off or turning-on corresponding branch depending on the control signal output from the sample unit;

the LED module consists of an LED array in which the LED is an LED with a controllable luminescence lifetime.

In the technical solution of the light emitting device of the present invention, n parallel branches, consisting of LED modules and constant current units which are in series connection with the LED modules, are connected to an output terminal of a rectification circuit, and by setting the current value, the turning-off voltage, and the turning-on voltage of the constant current unit of each branch, the periodic flickers generated due to changes in the voltage of the alternating current can be avoided. Because the current of each branch is constant, the changes in junction temperatures do not result in the current changing in LED, and the reliability is improved. As can be seen from the theoretical analysis, along with the increase of the number of the branches, the driving current waveform approximates a sine wave, and the power factor and the efficiency of the light emitting device are improved. Particularly, by using the LEDs with a controllable luminescence lifetime to construct an LED module, the LED flickers generated due to alternating current can be further reduced by taking advantage of the luminescence afterglow of the LEDs. In addition, the efficiency of the LED light emitting device is improved, and the lifetime of the LED is prolonged Specifically, the LED with a controllable luminescence lifetime has a luminescence lifetime of 1 to 100 ms.

The extension of the luminescence lifetime of the LED is helpful to eliminate the flickers.

Further, the luminescence lifetime is 10 to 30 ms.

The luminescence lifetime in such a range is matched with the alternating current cycle (1/50 s or 1/60 s), thereby appropriately exerting the advantage of afterglow. In addition, it is more easily realizable in the technology and the cost is lower.

Further, the LED array consists of at least one LED arranged on a same printed circuit board, or integratedly encapsulated on a same substrate, or integrated on a same semiconductor substrate.

Arranging all the LEDs of the LED module on a same printed circuit board is the simplest and most economic encapsulation method in the current process conditions; integratedly encapsulating all the LEDs of the LED module on a same substrate means performing a secondary encapsulation for all the LEDs of the LED module and integrating them on a same heat dissipation substrate; and integrating all the LEDs of the LED module on a same semiconductor substrate is to realize an LED integration on a same semiconductor substrate using the semiconductor integrated circuit process. Those technologies are mature LED integration encapsulation technologies at present.

Specifically, in each LED module, the LEDs are connected in parallel and/or series.

Through appropriate LED connections, such as parallel connection, series connection or series-parallel connection, the LED module is more suitable for the usage environment of being driven directly by constant current in manner of being supplied with alternating current, and it is convenient to adjust the current and voltage parameters of each LED module.

Further, the numbers of LEDs comprised in the first LED module, the second LED module, . . . , and the $n^{th}$ LED module are $1^2$, $2^2$, . . . and $n^2$, respectively, and the currents of corresponding constant current units are I, 2I, . . . and nI, respectively, wherein I is the current of the first constant current unit.

The distribution rule of the numbers of LEDs in the LED module can achieve the multiplied relation between the branch currents, so that the whole current waveform approaches the sine wave, which is helpful to improve the power factor and the efficiency of the light emitting device.

Further, when $n \geq 2$, a same LED belongs to different LED modules at the same time.

The solution may arrange the LEDs in each LED module alternatively, so that a same LED or several LEDs belong to different LED modules at the same time to achieve the LED multiplexing, thereby reducing the number of LEDs of the light emitting device, and improve the uniformity of the illumination brightness of the light emitting device, which is helpful to eliminate the flickers.

Specifically, the protection unit comprises a fuse in series connection with the alternating current input terminal, and a voltage-dependent resistor in parallel connection with the alternating current input terminal.

The fuse is a conventional current-limiting protection element, the voltage-dependent resistor is a conventional voltage-limiting protection element, and their combination achieves the most basic current-limiting protection and voltage-limiting protection. In addition, the cost is low, the mounting is convenient, and it is easy to perform a secondary integration.

Further, the protection unit further comprises a common mode choke in series connection with the alternating current input terminal, and/or a gas discharge tube in parallel connection with the alternating current input terminal.

The common mode choke and the gas discharge tube are added, wherein the common mode choke can suppress the common mode interference, and the gas discharge tube can protect the illumination device from being damaged such as by thunder.

Specifically, the rectifier unit is constructed by a full-wave rectification circuit or a half-wave rectification circuit consisting of rectifier diodes.

By using the rectifier diodes of a small size and a light weight as the rectifier elements, it is convenient to perform a secondary integrated encapsulation.

Specifically, the sample unit is constructed by a resistor network.

The resistor network is very suitable to collect direct current parameters, and it is convenient to set the action points for turning on and off the constant current unit.

The present invention has the following beneficial effect: the LED module is directly driven by the alternating current, the circuit is simple, the size is small, the weight is light, and the cost is low. By properly presetting the current and the on-off voltage of each branch, the periodic flickers of the LED light emitting device can be reduced when the alternating current fluctuates. When the instantaneous voltage of the alternating current is too high, the constant current unit is turned off, and the LED module does not emit light, thereby improving the utilization efficiency of the power supply and reducing the power loss. Meanwhile, the constant current control avoids the situation of burning out when the junction temperature changes and the current is too high, thereby prolonging the lifetime of the device. By using the LEDs with a controllable luminescence lifetime to construct an LED module, the LED flickers generated due to alternating current can be further reduced by taking advantage of the luminescence afterglow of the LEDs. In addition, the efficiency of the LED light emitting device is improved, and the lifetime of the LED is prolonged. In the present invention, the effect becomes obvious since the luminescence afterglow of the LEDs is combined with the advantages of the circuit.

DETAILED DESCRIPTION

The technical solutions of the present invention are detailedly described as follows with reference to the drawings and the embodiments.

The LED with a controllable luminescence lifetime refers to an LED with a luminescence lifetime of 1 to 100 ms. According to the definition of luminescence, the luminescence lifetime is the time for decreasing the luminescence intensity to 1/e of the maximum intensity during excitation.

In the present invention, the LED with a controllable luminescence lifetime includes one or more combinations of inorganic and/or organic luminescence materials, such as one or more of CaS:Eu; CaS:Bi, Tm; ZnS:Tb; $CaSrS_2$:Eu, Dy; $SrGa_2S_4$:Dy; $Ga_2O_3$:Eu; (Y, Gd)$BO_3$:$Eu^{3+}$; $Zn_2SiO_4$:$Mn^{2+}$; $YBO_3$:$Tb^{3+}$; Y(V, P)$O_4$:$Eu^{3+}$; $SrAl_2O_4$:$Eu^{2+}$; $SrAl_2O_4$:$Eu^{2+}$, B; $SrAl_2O_4$:$Eu^{2+}$, $Dy^{3+}$, B; $BaAl_2O_4$:$Eu^{2+}$; $CaAl_2O_4$:$Eu^{2+}$; $Sr_3SiO_5$:$Eu^{2+}$, $Dy^{3+}$; $BaMgAl_{10}O_{17}$:$Eu^{2+}$, $Mn^2$; Tb$(acac)_2$(AA)phen; $Y_2O_2S$:$Eu^{3+}$, $Y_2SiO_5$:$Tb^{3+}$; $SrGa_2S_4$:$Ce^{3+}$; $Y_3(Al, Ga)_5O_{12}$:$Tb^{3+}$; $Ca_2Zn_4Ti_{15}O_{36}$: $Pr^{3+}$; $CaTiO_3$:$Pr^{3+}$; $Zn_2P_2O_7$: $Tm^{3+}$; $Ca_2P_2O_7$:$Eu^{2+}$, $Y^{3+}$; $Sr_2P_2O_7$:$Eu^{2+}$, $Y^{3+}$; $Lu_2O_3$: Tb, $Sr_2Al_6O_{11}$:$Eu^{2+}$; $Mg_2SnO_4$:$Mn^{2+}$; $CaAl_2O_4$: $Ce^{3+}$, $Tb^{3+}$; $Sr_4Al_{14}O_{25}$:$Tb^{3+}$; $Ca_{10}(PO_4)_6$(F, Cl):Sb,Mn; $Sr_2MgSi_2O_7$:$Eu^{2+}$; $Sr_2CaSi_2O_7$:Eu; $Zn_3(PO_4)_2$:$Mn^{2+}$, $Ga^{3+}$; CaO:$Eu^{3+}$; $Y_2O_2S$:$Mg^{2+}$, $Ti^{3+}$; $Y_2O_2S$:$Sm^{3+}$; $SrMg_2(PO_4)_2$: $Eu^{2+}$, $Gd^{3+}$; $BaMg_2$ $(PO_4)_2$:$Eu^{2+}$, $Gd^{3+}$; $Zn_2SiO_4$:Mn, As; $KLaF_4$:Er; $CdSiO_3$:$Dy^{3+}$, $MgSiO_3$:$Eu^{2+}$, $Mn^{2+}$.

Figure 1:
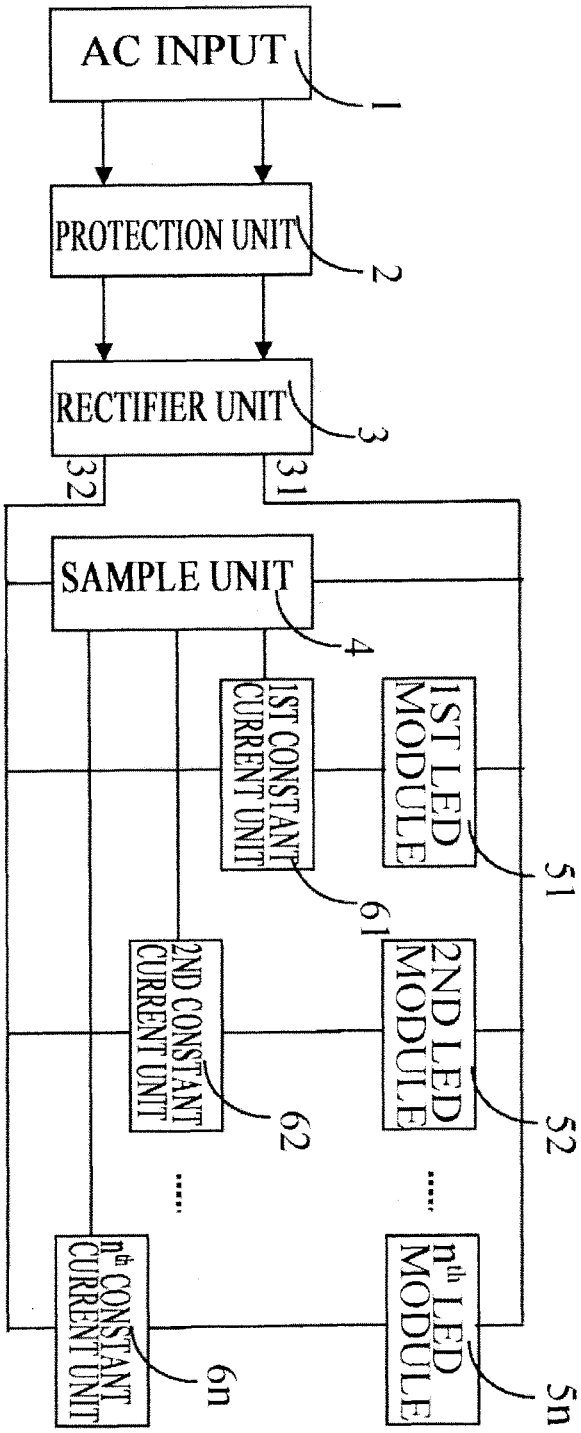
FIG. 1 is a structural block diagram of the present invention.

The structural block diagram of a white LED light emitting device directly driven by constant current in manner of being supplied with alternating current in the present invention is illustrated in FIG. 1, comprising an alternating current input terminal 1, a protection unit 2, a rectifier unit 3, and a first branch, a second branch, . . . , an $n^{th}$ branch connected in parallel between a first output terminal 31 (usually a positive pole) and a second output terminal 32 (usually a negative pole) of the rectifier unit 3. The first branch consists of a first LED module 51 and a first constant current unit 61 connected in series, the second branch consists of a second LED module 52 and a second constant current unit 62 connected in series, . . . , and the $n^{th}$ branch consists of an $n^{th}$ LED module 5*n* and an $n^{th}$ constant current unit 6*n* connected in series, each constant current unit being connected to a sample unit 4, wherein n≥1 and is an integer. The alternating current input terminal 1 is connected to the alternating current, for supplying driving current to the device; the protection unit 2 is connected to the alternating current input terminal 1, for providing a protection function to the device; the rectifier unit 3 is connected to the protection unit 2, for rectifying the alternating current output from the protection unit 2, thereby outputting sine wave pulse current (as illustrated in FIG. 5*a*); the sample unit 4 samples an output voltage of the rectifier unit, and outputs a control signal to each constant current unit; each constant current unit is connected to the sample unit 4, for keeping the current of corresponding branch to be constant, and for turning off or turning on corresponding branch depending on the control signal output from the sample unit.

The working principle of the present invention is briefly described as follows.

Figure 5:
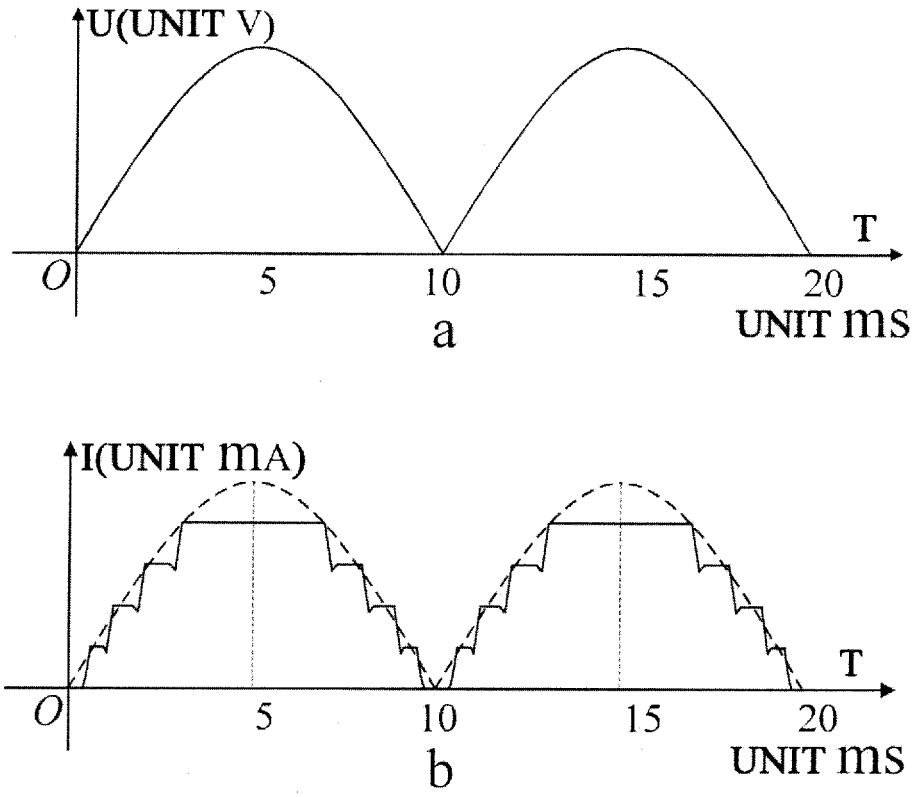
FIGS. 5A and 5B illustrate voltage and current waveforms.

The alternating current of the mains supply, usually sine wave alternating current, enters the protection unit 2 through the alternating current input terminal 1, and becomes a sine wave pulse voltage with a voltage waveform as illustrated in FIG. 5*a* after being rectified by the rectifier unit 3. Within an alternating current cycle T, when the input voltage rises and reaches a turn-on voltage of the first LED module 51, the first LED module 51 enters the working state and the current gradually rises; after a preset current of the first constant current unit 61 is reached, the first LED module 51 works at the preset current in a constant current state. When the voltage continues rising and reaches a preset turning-off voltage of the first constant current unit 61, the first constant current unit 61 is turned off, and the first LED module 51 does not emit light. In that case, the second constant current unit 62 is turned on, and the second LED module 52 starts to work. After entering a constant current state, the second LED module 52 maintains the constant current working state at the current set by the second constant current unit 62. When the voltage continues rising, the second constant current unit 62 is turned off, and so on, until the $n^{th}$ LED module 5*n* starts to work, and the preceding constant current units are all turned off. It is assumed that the constant current of the first constant current unit 61 is I, the constant current of the second constant current unit 62 is 2I, . . . , and the constant current of the $n^{th}$ constant current unit is nI. Theoretically, the current waveform is more approximate to the sine wave when the number of the constant current unit groups increases, as illustrated in FIG. 5*b*. Meanwhile, the power factor and efficiency also increase, but the circuit becomes more complex and the layout and wiring are more difficult. Thus, in the practical applications, a limited number of branches are formed by selecting a limited number of constant current units and corresponding number of LED modules.

Embodiment 1

Figure 2:
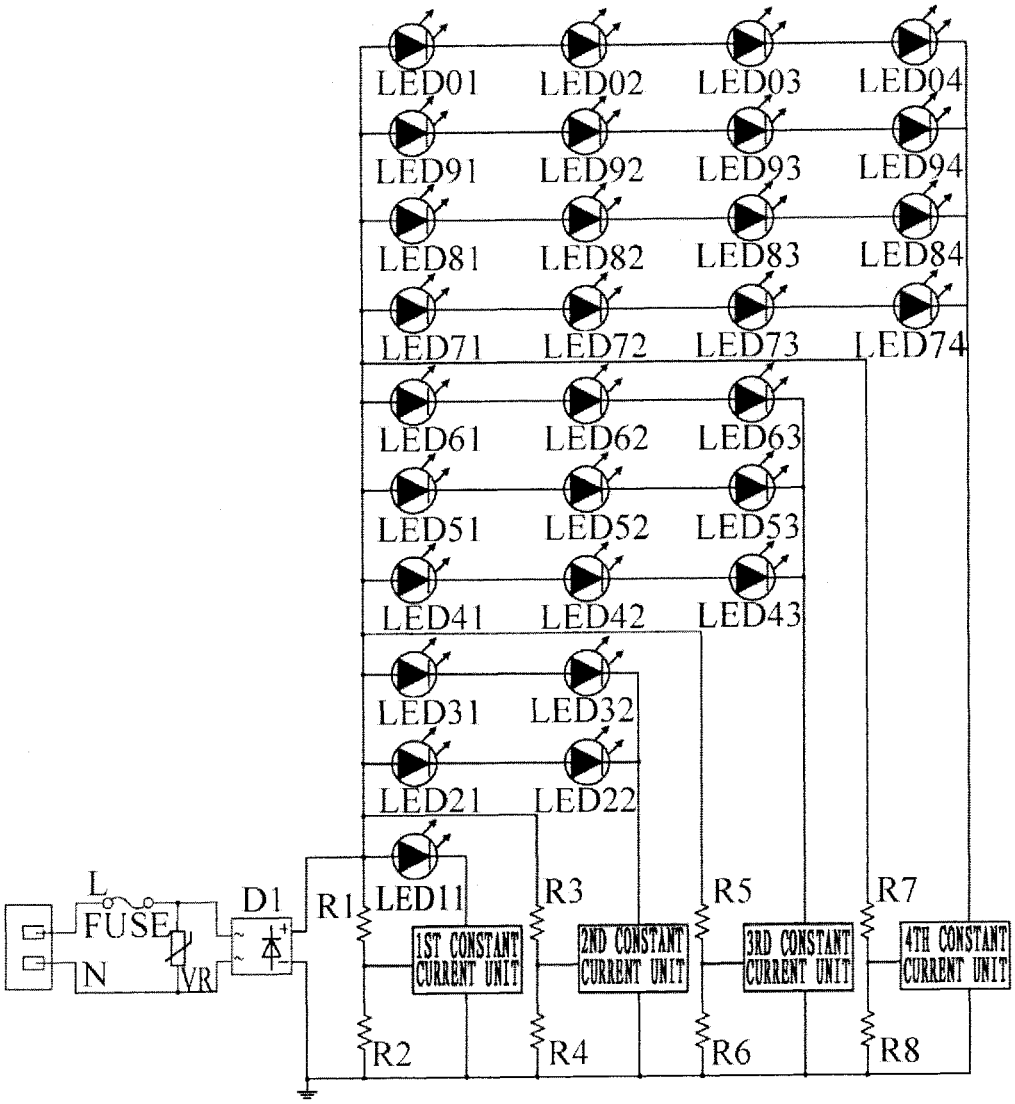
FIG. 2 is a circuit principle diagram of Embodiment 1.

As illustrated in FIG. 2, the protection unit 2 of this embodiment consists of a fuse F in series connection with a phase line L of the alternating current input terminal 1, and a voltage-dependent resistor VR in parallel connection between the phase line L and a null line N of the alternating current input terminal 1. The protection unit 2 is connected to the rectifier unit 3 constructed by a full wave rectification circuit D1 and having the output terminal in parallel connection with four branches The first branch consists of the first LED module and the first constant current unit connected in series, wherein the first LED module is constructed by an LED 11 with a positive end connected to the positive pole of the rectification circuit D1, and a negative end connected to the negative pole of the rectification circuit D1 through the first constant current unit. In this embodiment, the sample unit is constructed by a resistor network, including resistors R1 to R8, wherein resistors R1 and R2 are in serial connection and then connected in parallel between the positive pole and the negative pole of the rectification circuit D1, the connection point of resistors R1 and R2 is sample point of the first constant current unit and connected to the control end of the first constant current unit. In the second branch of this embodiment, the second LED module is constructed by a 2×2 array composed of 4 LEDs, including LED 21, LED 22, LED 31 and LED 32 arranged into two groups each having two LEDs connected in series in the same direction, and the two groups are connected in parallel at the same polarity, as illustrated in FIG. 2. The second LED module has a positive end connected to the positive pole of the rectification circuit D1, and a negative end connected to the negative pole of the rectification circuit D1 through the second constant current unit. Resistors R3 and R4 are in serial connection and then connected in parallel between the positive pole and the negative pole of the rectification circuit D1, the connection point of resistors R3 and R4 is sample point of the second constant current unit and connected to the control end of the second constant current unit. In the third branch of this embodiment, the third LED module is constructed by a 3×3 array composed of 9 LEDs, including LED 41, LED 42, LED 43, LED 51, LED 52, LED 53, LED 61, LED 62 and LED 63 arranged into three groups each having three LEDs connected in series in the same direction, and the three groups are connected in parallel at the same polarity, as illustrated in FIG. 2. The third LED module has a positive end connected to the positive pole of the rectification circuit D1, and a negative end connected to the negative pole of the rectification circuit D1 through the third constant current unit. Resistors R5 and R6 are in serial connection and then connected in parallel between the positive pole and the negative pole of the rectification circuit D1, the connection point of resistors R5 and R6 is sample point of the third constant current unit and connected to the control end of the third constant current unit. In the fourth branch of this embodiment, the fourth LED module is constructed by a 4×4 array composed of 16 LEDs, including LED 71, LED 72, LED 73, LED 74, LED 81, LED 82, LED 83, LED 84, LED 91, LED 92, LED 93, LED 94, LED 01, LED 02, LED 03 and LED 04 arranged into four groups each having four LEDs connected in series in the same direction, and the four groups are connected in parallel at the same polarity, as illustrated in FIG. 2. The fourth LED module has a positive end connected to the positive pole of the rectification circuit D1, and a negative end connected to the negative pole of the rectification circuit D1 through the fourth constant current unit. Resistors R7 and R8 are in serial connection and then connected in parallel between the positive pole and the negative pole of the rectification circuit DE the connection point of resistors R7 and R8 is sample point of the fourth constant current unit and connected to the control end of the fourth constant current unit. Herein the negative pole of the rectification circuit D1 is a common ground terminal The light emitting device of this embodiment obtains the power of the alternating current by being connected to the grid through a plug. The alternating current passes through the protection unit, then it is rectified into direct current by the rectifier unit (strictly speaking, sine wave pulse direct current with a waveform as illustrated in FIG. 5*a*) and supplied to the voltage sample unit, the constant current unit and the LED module. In each alternating current cycle I, the output voltage of the rectification circuit D1 rises from zero. When the voltage reaches the turn-on voltage of the first LED module, the first constant current unit is turned on, and the first LED module starts to emit light to enter the working state. When the voltage continues rising, the first constant current unit works at a set constant current of 20 mA, so that the current of the first LED module reaches a rated current of 20 mA. When the voltage reaches a preset turning-off voltage of the first constant current unit, the first constant current unit is turned off, the first LED module stops working and goes out, while the second LED module starts to emit light and enters the working state. When the voltage continues rising, the second constant current unit works at a set constant current of 40 mA, so that the current of the second LED module reaches a rated current of 40 mA. When the voltage reaches a preset turning-off voltage of the second constant current unit, the second constant current unit is turned off, the second LED module stops working, while the third LED module starts to work. When the voltage continues rising, the third constant current unit works at a set constant current of 60 mA, so that the current of the third LED module reaches a rated current of 60 mA. When the voltage reaches a preset turning-off voltage of the third constant current unit, the third constant current unit is turned off, the fourth constant current unit is turned on, and the fourth LED module starts to work. When the voltage continues rising, the fourth constant current unit works at a set constant current of 80 mA, so that the current of the fourth LED module reaches a rated current of 80 mA. FIG. 5*b* is a schematic diagram of a current waveform of this embodiment. As can be seen from FIG. 5*b*, the current is multiplied at different stages, and the waveform approaches sine. Thus the light emitting device of this embodiment has very high efficiency and power factor. The fourth constant current unit also has the protection function, and when the voltage exceeds a preset turning-off voltage of the fourth constant current unit, the fourth constant current unit is turned off. In this way, the LED modules in the light emitting device are all turned off, so as to protect the light emitting device from being damaged.

In this embodiment, the LED array in each LED module (the LED module of the first branch of this embodiment can also be regarded as a 1×1 LED array) may be composed of LEDs which are arranged on a same printed circuit board, or integratedly encapsulated on a same heat dissipation substrate using the integrated encapsulation technology, or integrated on a same semiconductor substrate using the integrated circuit process.

Embodiment 2

Figure 3:
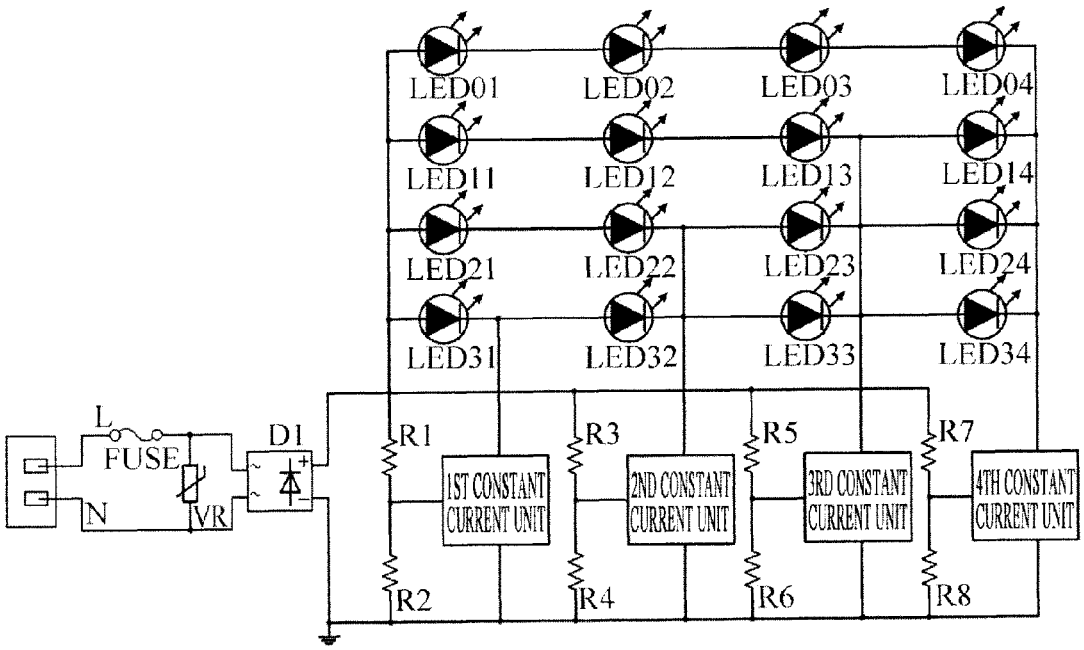
FIG. 3 is a schematic diagram of Embodiment 2.

FIG. 3 is a schematic diagram of a circuit of this embodiment. As can be seen from FIG. 3, the structures in this embodiment, except the LED module and its connection mode, are the same as those in Embodiment 1. Next, only the structures of the LED modules of the four branches are described, and other structures and their working processes are omitted herein, and please refer to Embodiment 1 for the details. In the first branch of this embodiment, the first LED module is constructed by an LED 31, with a positive end connected to the positive pole of the rectification circuit D1, and a negative end connected to the negative pole of the rectification circuit D1 through the first constant current unit. In the second branch of this embodiment, the second LED module includes 4 LEDs, i.e., LED 31, LED 32, LED 21 and LED 22. When the first constant current unit is turned off, the four LEDs construct a 2×2 array, wherein LED 31 and LED 32 are connected in series in the same direction to form a group, and LED 21 and LED 22 are connected in series in the same direction to form another group, and the two groups are connected in parallel at the same polarity to form a second LED module. The second LED module has a positive end connected to the positive pole of the rectification circuit D1, and a negative end connected to the negative pole of the rectification circuit D1 through the second constant current unit. The third LED module of this embodiment includes 9 LEDs, i.e., LED 31, LED 32, LED 33, LED 21, LED 22, LED 23, LED 11, LED 12 and LED 13. When the first constant current unit and the second constant current unit are both turned off, the 9 LEDs construct a 3×3 array, wherein LED31, LED32 and LED33 are connected in series in the same direction to form a group, LED21, LED22 and LED23 are connected in series in the same direction to form another group, and LED11, LED12 and LED13 are connected in series in the same direction to form still another group, and the three groups are connected in parallel at the same polarity to form a third LED module. The third LED module has a positive end connected to the positive pole of the rectification circuit D1, and a negative end connected to the negative pole of the rectification circuit D1 through the third constant current unit. Similarly, when the first constant current unit, the second constant current unit and the third constant current unit in FIG. 3 are all turned off, four groups of LEDs (LED 31, LED 32, LED 33, LED 34, LED 21, LED 22, LED 23, LED 24, LED 11, LED 12, LED 13, LED 14, LED 01, LED 02, LED 03 and LED 04) connected in series in the same direction construct a 4×4 array to form a fourth LED module of this embodiment. The fourth LED module has a positive end connected to the positive pole of the rectification circuit D1, and a negative end connected to the negative pole of the rectification circuit D1 through the fourth constant current unit. Like Embodiment 1, the currents of each branch are also in a multiplied relation, i.e., if the current of the first branch is I, the currents of other branches are 2I, 3I and 4I, successively.

In this embodiment, the LEDs in each LED module employ the combination of serial and parallel connections, and some LEDs belong to multiple LED modules at the same time. For example in FIG. 3, LED 31 belongs to all the LED modules at the same time; LED 22 and LED 32 belong to the second to fourth LED modules at the same time; LED 33, LED 23 and LED 13 belong to the third and fourth LED modules at the same time. Due to the multiplex structure, the number of the light emitting units is greatly reduced, the cost of the light emitting device is decreased, and it is helpful to eliminate the flickers.

Embodiment 3

Figure 4:
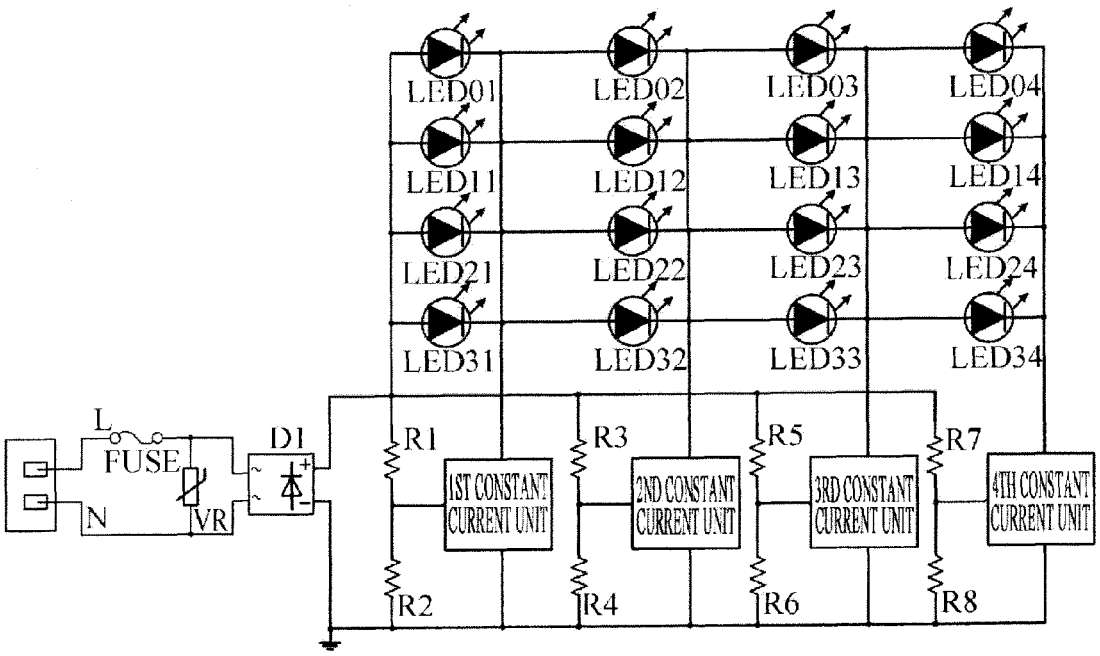
FIG. 4 is a schematic diagram of Embodiment 4.

As illustrated in FIG. 4, the schematic diagram of a circuit of this embodiment differs from Embodiment 2 in that the connection mode of each LED module is further optimized, wherein the four LED modules in the four branches consist of 16 LEDs and employ a 4×4 matrix topological structure. The first LED module of this embodiment is constructed by a 1×4 array composed of 4 LEDs (LED 01, LED 11, LED 21 and LED 31) connected in parallel. The second LED module of this embodiment is constructed by a 2×4 array composed of 8 LEDs (LED 01, LED 11, LED 21, LED 31, LED 02, LED 12, LED 22 and LED32) connected in series and parallel combined. The third LED module of this embodiment is constructed by a 3×4 array composed of 12 LEDs (LED 01, LED 11, LED 21, LED 31, LED 02, LED 12, LED 22, LED 32, LED 03, LED 13, LED 23 and LED 33) connected in series and parallel combined. The fourth LED module of this embodiment is constructed by a 4×4 array composed of 16 LEDs (LED 01, LED 11, LED 21, LED 31, LED 02, LED 12, LED 22, LED 32, LED 03, LED 13, LED 23, LED 33, LED 04, LED 14, LED 24 and LED 34) connected in series and parallel combined. Please refer to the previous embodiment for the connection relations and working principles of other parts. The circuit of this embodiment is mainly characterized in that the currents of the branches are the same, i.e., the same current is set for all the constant current units, i.e., 4 times of the constant driving current of one LED As can be seen from the above detailed descriptions, the voltage sample unit of the present invention monitors the input voltage, and also protects the LED module. When the voltage of the alternating current fluctuates largely, the constant current unit can be turned off in time to protect the LED module from being damaged if the current is too high. The constant current unit of the present invention may consist of separate elements and/or an integrated circuit, and it requires an on-off control function (i.e., the turning-off and turning-on control can be performed). Since the specific circuit is the mature technology in the art, it is not described in details herein To be noted, although the structure of the present invention has been described in details in the above embodiments, the present invention is not limited to those embodiments. Any substitutive structure, which is conceivable by a person skilled in the art from those embodiments without paying a creative effort, shall fall within the protection scope of the present invention.

What is claimed is:

1. A white light emitting diode (LED) light emitting device driven directly by constant current in manner of being supplied with alternating current, comprising:

an alternating current input terminal;

a protection unit;

a rectifier unit;

a first branch, a second branch, and an $n^{th}$ branch, wherein the branches are connected in parallel between a first output terminal and a second output terminal of the rectifier unit, wherein the first branch comprises a first LED module and a first constant current unit connected in series, the second branch comprises a second LED module and a second constant current unit connected in series, and the $n^{th}$ branch comprises an $n^{th}$ LED module and an $n^{th}$ constant current unit connected in series, each constant current unit being connected to a sample unit, wherein $n \geq 1$ and n is an integer;

wherein the alternating current input terminal is connected to the alternating current, for supplying driving current to the device, wherein the protection unit is connected to the alternating current input terminal, for providing a protection function to the device, wherein the rectifier unit is connected to the protection unit, for rectifying the alternating current output from the protection unit, wherein the sample unit samples an output voltage of the rectifier unit, and outputs a control signal to each constant current unit, wherein each constant current unit is connected to the sample unit, for keeping the current of corresponding branch to be constant, and for turning-off or turning-on corresponding branch depending on the control signal output from the sample unit, wherein the LED module comprises LED arrays, wherein luminescence lifetime of LED in the LED arrays is controllable, and wherein the number of LEDs comprised in the first LED module, the second LED module, and the nth LED module are $1^2$, $2^2$ and $n^2$, respectively, and the current of corresponding constant current units are I, 2I and nI, respectively, wherein I is the current of the first constant current unit.

2. The white LED light emitting device driven directly by constant current in manner of being supplied with alternating current according to claim 1, wherein the luminescence lifetime of the LED is 1 to 100 ms.

3. The white LED light emitting device driven directly by constant current in manner of being supplied with alternating current according to claim 2, wherein the luminescence lifetime is 10 to 30 ms.

4. The white LED light emitting device driven directly by constant current in manner of being supplied with alternating current according to claim 1, wherein the LED array comprises at least one LED arranged on a same printed circuit board, or at least one LED integratedly encapsulated on a same substrate, or at least one LED integrated on a same semiconductor substrate.

5. The white LED light emitting device driven directly by constant current in manner of being supplied with alternating current according to claim 1, wherein in each LED module, the LEDs are connected in parallel or series.

6. The white LED light emitting device driven directly by constant current in manner of being supplied with alternating current according to claim 1, wherein when $n \geq 2$, one single same LED belongs to different LED modules at the same time.

7. The white LED light emitting device driven directly by constant current in manner of being supplied with alternating current according to claim 1, wherein the protection unit comprises a fuse in series connection with the alternating current input terminal, or a voltage-dependent resistor in parallel connection with the alternating current input terminal.

8. The white LED light emitting device driven directly by constant current in manner of being supplied with alternating current according to claim 7, wherein the protection unit further comprises a common mode choke in series connection with the alternating current input terminal, or a gas discharge tube in parallel connection with the alternating current input terminal.

9. The white LED light emitting device driven directly by constant current in manner of being supplied with alternating current according to claim 1, wherein the rectifier unit is constructed by a full-wave rectification circuit or a half-wave rectification circuit comprising rectifier diodes.

10. The white LED light emitting device driven directly by constant current in manner of being supplied with alternating current according to claim 1, wherein the sample unit is constructed by a resistor network.

* * * * *